US011071398B2

(12) United States Patent
Hicks et al.

(10) Patent No.: US 11,071,398 B2
(45) Date of Patent: Jul. 27, 2021

(54) CONVERTIBLE APPAREL RACK

(71) Applicant: Walmart Apollo, LLC, Bentonville, AR (US)

(72) Inventors: Nathan M. Hicks, Rogers, AR (US); Jeffrey D. Green, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 16/255,343

(22) Filed: Jan. 23, 2019

(65) Prior Publication Data

US 2019/0223628 A1 Jul. 25, 2019

Related U.S. Application Data

(60) Provisional application No. 62/620,792, filed on Jan. 23, 2018.

(51) Int. Cl.
*A47F 7/24* (2006.01)
*A47F 5/10* (2006.01)
(Continued)

(52) U.S. Cl.
CPC ..... *A47F 7/24* (2013.01); *A47B 47/0058* (2013.01); *A47B 47/0083* (2013.01);
(Continued)

(58) Field of Classification Search
CPC .... A47F 5/10; A47F 5/101; A47F 7/24; A47F 5/137; A47F 5/108; A47F 7/08;
(Continued)

(56) References Cited

U.S. PATENT DOCUMENTS 430,340 A * 6/1890 Eyles ..... A47F 7/24 211/206
1,008,477 A * 11/1911 Kohn ..... A47F 7/24 211/204

(Continued)

FOREIGN PATENT DOCUMENTS

CN 202786847 * 3/2013
CN 205682903 * 11/2016

(Continued)

OTHER PUBLICATIONS

International Search Report and Written Opinion for Application No. PCT/US2019/014716, dated Mar. 21, 2019, 8 pages.

*Primary Examiner* — Jonathan Liu
*Assistant Examiner* — Devin K Barnett
(74) *Attorney, Agent, or Firm* — Fitch, Even, Tabin & Flannery, LLP

(57) ABSTRACT

A convertible apparel rack functions as a multi-purpose rack that can display garments, shoes, or a combination of both, by changing out the hanger bars. Further, the rack can be changed from a single rack to a dual rack by removing or inserting uprights on a standard base. The apparel hanger bars are solid and of sufficient strength to allow dense packing of apparel without mechanical failure. The shoe hanger bars have a gap to allow shoes to be clipped on. Further, the convertible apparel rack can display a single rack of items or can be configured to display two racks of items.

17 Claims, 13 Drawing Sheets

(51) Int. Cl.

| | |
|---|---|
| ***A47F 7/08*** | (2006.01) |
| ***A47B 57/54*** | (2006.01) |
| ***A47F 5/13*** | (2006.01) |
| ***A47B 47/00*** | (2006.01) |

(52) U.S. Cl.

CPC ..... *A47B 57/545* (2013.01); *A47F 5/10* (2013.01); *A47F 5/101* (2013.01); *A47F 5/108* (2013.01); *A47F 5/137* (2013.01); *A47F 7/08* (2013.01); *A47B 47/00* (2013.01)

(58) Field of Classification Search

CPC ..... A47B 57/545; A47B 47/0058; A47B 47/0083; A47B 47/00

USPC ..... 211/85.3, 204, 206, 85.8; 206/278, 279, 206/298; 280/47.35, 79.3, 33.995, 33.998

See application file for complete search history.

(56) References Cited

U.S. PATENT DOCUMENTS 2,110,158 A * 3/1938 Keeler ..... A47G 25/0678 211/182
D131,907 S * 4/1942 Sarvis ..... D6/681
2,557,262 A * 6/1951 Cordes ..... A47F 7/24 211/191
3,123,221 A * 3/1964 Haag ..... A47G 25/0664 211/187
3,272,345 A * 9/1966 Wallace ..... A47F 7/175 211/44
3,689,098 A * 9/1972 Rubin ..... B62B 3/005 280/33.998
3,857,494 A * 12/1974 Giardini ..... A47B 47/05 211/194
D237,898 S * 12/1975 Austin ..... D11/144
4,419,938 A * 12/1983 Kaut ..... A47B 47/05 108/101
4,512,591 A * 4/1985 Plante ..... B62B 3/002 108/109
4,555,029 A * 11/1985 Fiol ..... B62H 3/10 211/189
4,585,127 A 4/1986 Benedict
4,677,780 A * 7/1987 Shuman ..... G09F 3/18 211/DIG. 1
4,688,687 A 8/1987 Pryor
5,090,725 A * 2/1992 Feldner ..... B62B 3/02 211/189
5,368,174 A 11/1994 Clark et al.
D357,102 S * 4/1995 Tate ..... D34/17
5,624,044 A * 4/1997 Black, Jr. ..... G09F 7/18 211/186
5,718,441 A * 2/1998 Kern ..... A47B 57/14 211/187
5,875,904 A * 3/1999 Vorstenbosch ..... B62B 3/002 211/180
5,918,750 A * 7/1999 Jackson ..... A47F 5/137 108/108
6,123,207 A * 9/2000 Mast ..... A47B 43/00 211/149
6,135,299 A * 10/2000 Burgess ..... A47B 46/00 211/150
6,401,947 B1 6/2002 Hu et al.
6,402,167 B1 * 6/2002 Calleja ..... B62B 3/006 108/55.1
D474,350 S * 5/2003 Sardis ..... D6/681.1
6,644,484 B1 * 11/2003 Sardis ..... A47B 43/00 211/189
6,736,279 B2 * 5/2004 Allen ..... A47F 5/137 211/189
D491,742 S * 6/2004 Harwanko ..... D6/681.1
D495,523 S * 9/2004 Harwanko ..... D6/681.1
7,084,769 B2 8/2006 Bauer et al.
D613,965 S * 4/2010 Tertel ..... D6/675.5
7,946,434 B1 5/2011 Greenspon
8,135,482 B2 * 3/2012 Caldwell ..... A47B 57/00 211/119.003
8,251,233 B1 * 8/2012 Biglow ..... A47F 5/101 211/187
8,267,261 B2 * 9/2012 Vanderhoek ..... A01G 9/143 211/150
8,342,544 B1 * 1/2013 Blewett ..... B62B 3/022 211/189
8,505,933 B2 * 8/2013 Bernard ..... B62B 3/005 280/33.995
8,616,388 B2 * 12/2013 Butler ..... A47B 43/00 108/106
8,646,855 B2 * 2/2014 Rahilly ..... A47B 61/02 211/94.01
8,936,166 B2 1/2015 Hornsby
9,082,323 B1 * 7/2015 Dougherty ..... G09F 23/06
9,138,052 B2 9/2015 Kagramanyan
9,296,406 B2 * 3/2016 Presley ..... B62B 3/108
9,418,267 B1 * 8/2016 Josey ..... H01Q 1/243
9,526,355 B1 * 12/2016 Rollins ..... A47F 5/0056
D777,483 S * 1/2017 Bittie ..... D6/681
9,622,597 B2 4/2017 White
9,737,141 B2 * 8/2017 Johnson ..... A47B 55/02
10,064,501 B2 * 9/2018 Hester-Redmond .... A47F 1/125
10,384,703 B2 * 8/2019 Green ..... G06Q 20/203
10,479,384 B2 * 11/2019 Green ..... B62B 3/006
2002/0005389 A1 * 1/2002 Guo ..... B65D 85/185 211/85.3
2002/0121493 A1 * 9/2002 Wang ..... A47F 7/19 211/195
2004/0159026 A1 * 8/2004 Anderson ..... A47F 7/02 40/600
2005/0040934 A1 * 2/2005 Shanton ..... A47F 5/11 340/5.92
2005/0284011 A1 * 12/2005 Todd ..... G09F 7/04 40/600
2006/0091096 A1 * 5/2006 Velez ..... B62B 3/002 211/194
2007/0022644 A1 * 2/2007 Lynch ..... A47B 13/08 40/446
2008/0046345 A1 * 2/2008 Serre ..... G06Q 10/087 705/28
2008/0116156 A1 * 5/2008 Park ..... A47B 87/0207 211/59.2
2008/0222934 A1 9/2008 Dworetz
2009/0095697 A1 * 4/2009 Gabriel ..... B62B 3/006 211/206
2011/0042331 A1 * 2/2011 Johnson ..... A47F 3/002 211/49.1
2011/0192064 A1 * 8/2011 Bowman ..... G09F 7/04 40/600
2011/0253656 A1 * 10/2011 Vermeer ..... A47F 5/137 211/85.8
2012/0097628 A1 * 4/2012 Blacknell ..... A47B 45/00 211/85.3
2012/0228240 A1 * 9/2012 Gentile ..... A47F 5/08 211/1
2013/0048724 A1 * 2/2013 Burnside ..... G06Q 10/087 235/385
2013/0146553 A1 * 6/2013 Preidt ..... A47F 5/00 211/153
2014/0083005 A1 * 3/2014 Collins ..... A01G 9/02 47/66.6
2014/0167919 A1 * 6/2014 Singh ..... A47B 43/00 340/10.1
2014/0217044 A1 * 8/2014 Cole ..... B25H 3/028 211/85.8
2014/0247116 A1 * 9/2014 Davidson ..... G06Q 10/087 340/10.1
2014/0262659 A1 * 9/2014 Hirsch ..... A47B 61/06 190/13 R
2015/0076779 A1 * 3/2015 Lindblom ..... A47F 5/137 280/47.35
2015/0262516 A1 * 9/2015 White ..... A47F 13/06 40/600

(56) References Cited

U.S. PATENT DOCUMENTS

| | | | | |
|---|---|---|---|---|
| 2015/0289652 | A1* | 10/2015 | Strahinic | A47B 21/0314 211/85.8 |
| 2016/0000238 | A1* | 1/2016 | Bruegmann | A47F 5/13 211/149 |
| 2016/0055447 | A1* | 2/2016 | Sehmer | G06Q 10/087 235/385 |
| 2018/0005552 | A1 | 1/2018 | Lapp et al. | |
| 2018/0160801 | A1* | 6/2018 | Felsenthal | A47B 47/00 |

FOREIGN PATENT DOCUMENTS

| | | | |
|---|---|---|---|
| CN | 206324455 | U | 7/2017 |
| GB | 1246365 | A | 9/1971 |
| KR | 10-2012-0079873 | A | 7/2012 |
| WO | 2008/029007 | A1 | 3/2008 |

* cited by examiner

CONVERTIBLE APPAREL RACK

CROSS-REFERENCE TO RELATED PATENT APPLICATIONS

This application claims priority to U.S. Provisional Patent Application No. 62/620,792, filed on Jan. 23, 2018, the content of which is hereby incorporated by reference in its entirety.

BACKGROUND

In a retail environment, apparel racks are used to display goods. Different goods may require different apparel racks. Racks may also come in different versions, such as a single rack version or a dual rack version. Each individual apparel rack requires storage space when not in use.

SUMMARY

A convertible apparel rack functions as a multi-purpose rack that can display garments, shoes, or a combination of both, by changing out the hanger bars. Further, the rack can be changed from a single rack to a dual rack by removing or inserting uprights on a standard base. The apparel hanger bars are solid and of sufficient strength to allow dense packing of apparel without mechanical failure. The shoe hanger bars have a gap to allow shoes to be clipped on. Further, the convertible apparel rack can display a single rack of items or can be configured to display two racks of items.

In one embodiment the convertible apparel rack includes a base. The base comprises a first set of three upright supports along a first side of the base, a second set of three upright supports along a second side of the base, a first base support in mechanical communication with the first set of three upright supports, and a second base support in mechanical communication with the second set of three upright supports. The base may further include a first caster disposed proximate a first end of said first base support, a second caster disposed proximate a second end of said first base support, a third caster disposed proximate a first end of said second base support, and a fourth caster disposed proximate a second end of said second base support. The convertible apparel rack also includes a first upright in removable mechanical communication with the base, a second upright in removable mechanical communication with the base, and a first hanger bar removably attachable to the first upright and the second upright. The convertible apparel rack can be configured as a single rack display for garments, a single rack display for shoes, a double rack display for garments, a double rack display for shoes, or a double rack display for garments and shoes.

BRIEF DESCRIPTION OF THE DRAWINGS

The accompanying drawings, which are incorporated in and constitute a part of this specification, illustrate one or more embodiments of the invention and, together with the description, help to explain the invention. The drawings are not necessarily to scale, or inclusive of all elements of a system, emphasis instead generally being placed upon illustrating the concepts, structures, and techniques sought to be protected herein. In the drawings.

DETAILED DESCRIPTION

Figure 1A:
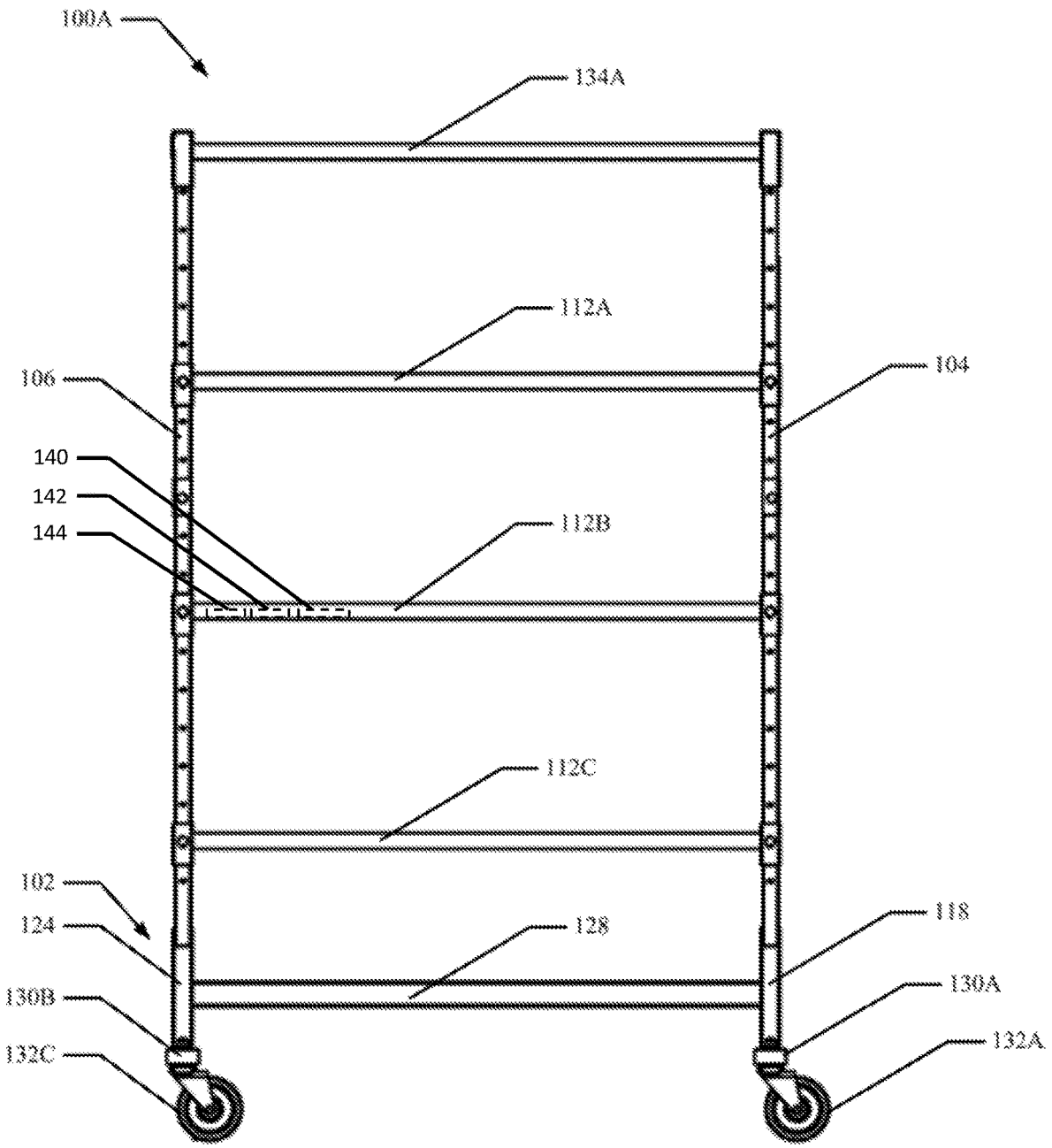
FIG. 1A is a front view diagram of a convertible apparel rack, according to an example embodiment.
Figure 1B:
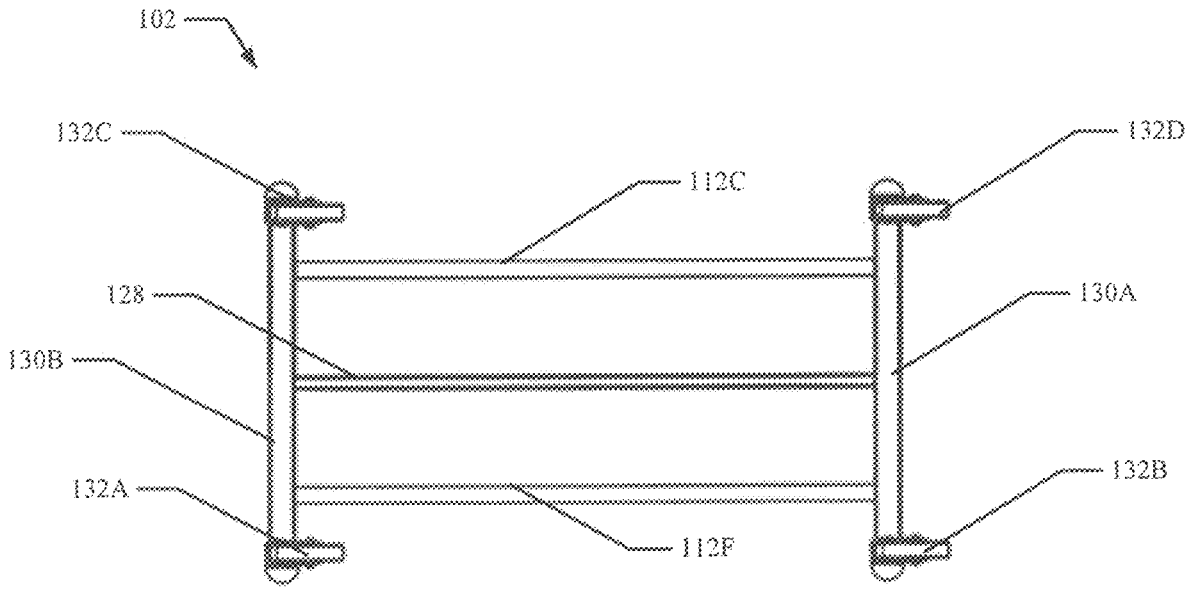
FIG. 1B is a bottom view diagram of a convertible apparel rack, according to an example embodiment.
Figure 1C:
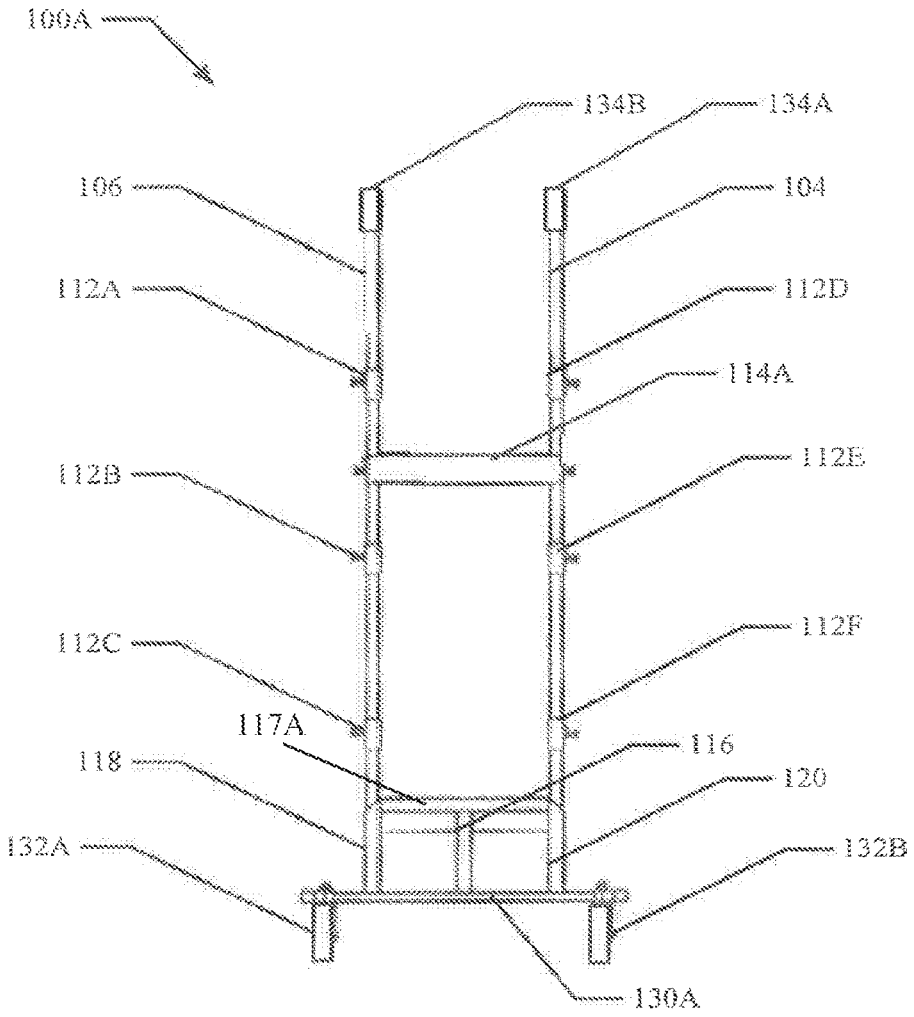
FIG. 1C is a side view diagram of a convertible apparel rack, according to an example embodiment.

Apparel racks that are used to display garments may not be able to be used to display shoes. Similarly, apparel racks that are used to display shoes may not be able to be used to display garments. The presence of multiple types of racks to display shoes and garments in a facility may take up too much space. Embodiments of the present invention address this issue by providing a multi-purpose convertible apparel rack that can display clothing, shoes, or a combination of both, by changing out the hanger bars and uprights on a standard base. In one embodiment the shoes hanger bars have a gap to allow shoes to be clipped on, and solid apparel bars of sufficient strength to allow dense packing of apparel without mechanical failure while providing clothing hanging density that is much greater than that of shoes. The multi-purpose convertible apparel rack may also be converted between uses as a single rack display or used as a dual rack display.

Referring to FIGS. 1A to 1D, a first embodiment 100*a* of a convertible apparel rack is shown. This embodiment is used to display two rows of clothing and may be referred to as a dual garment rack. The convertible apparel rack 100*a* includes a base 102. A first upright 104 is in removable mechanical communication with the base 102 by being inserted into upright support 118 at a first corner. A second upright 106 is in removable mechanical communication with the base 102 by being inserted into upright support 124 at a second corner. A third upright 108 is in removable mechanical communication with the base 102 by being inserted into upright support 120 at a third corner. A fourth first upright 110 is in removable mechanical communication with the base 102 by being inserted into upright support 126 at a fourth corner.

Figure 1D:
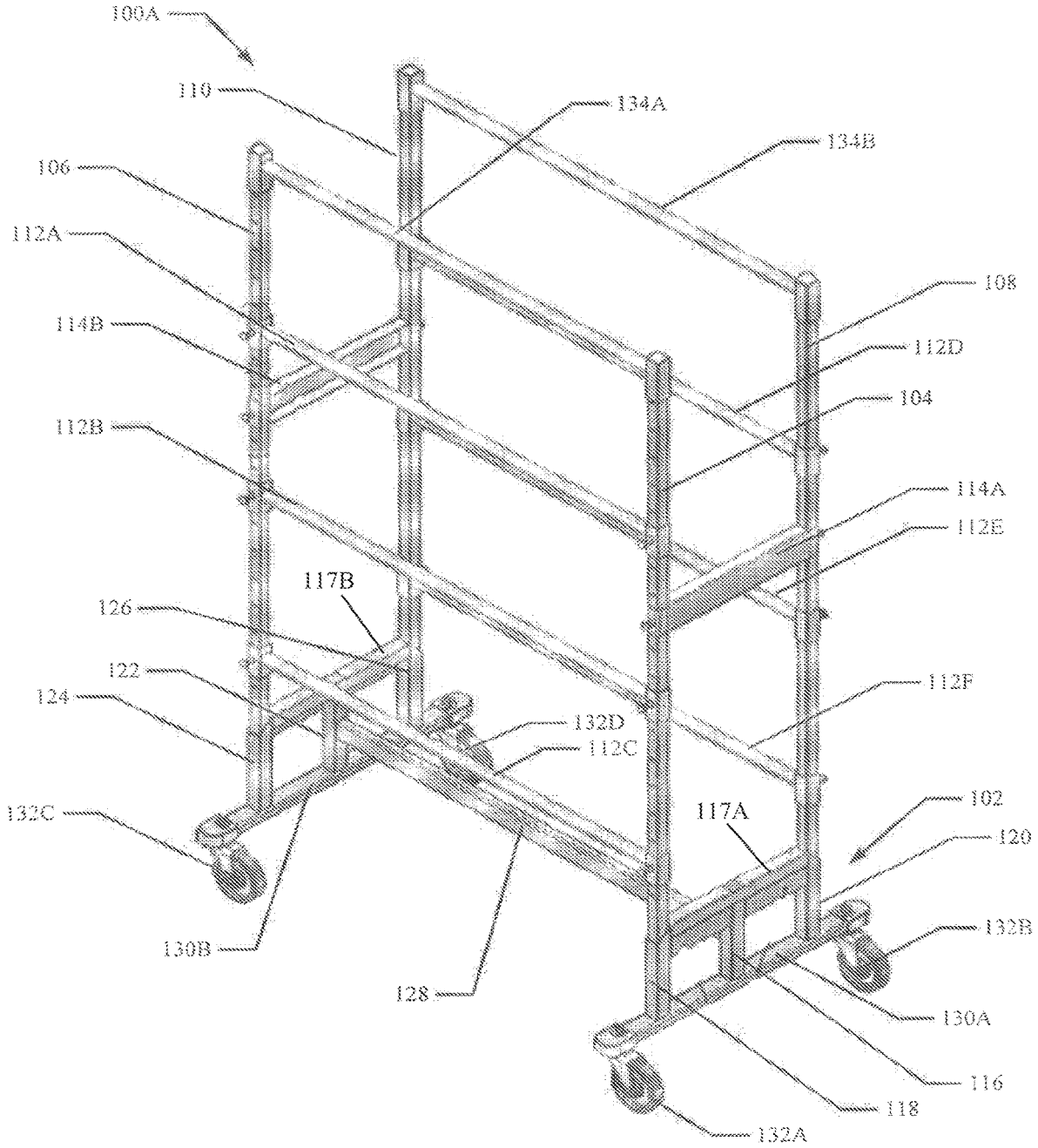
FIG. 1D is an isometric view diagram of a convertible apparel rack, according to an example embodiment.
Figure 2A:
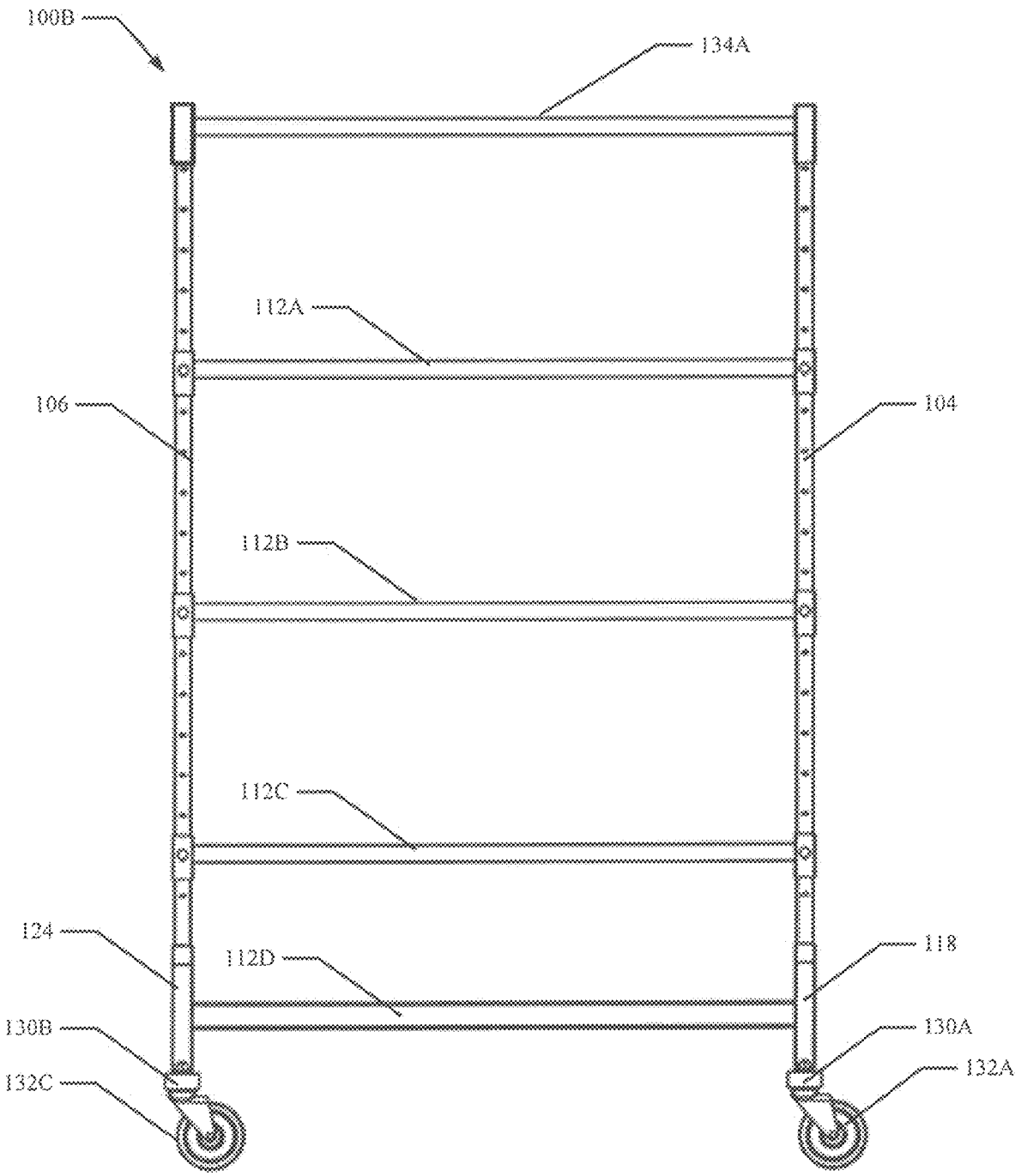
FIG. 2A is a front view diagram of a convertible apparel rack, according to another example embodiment.
Figure 2B:
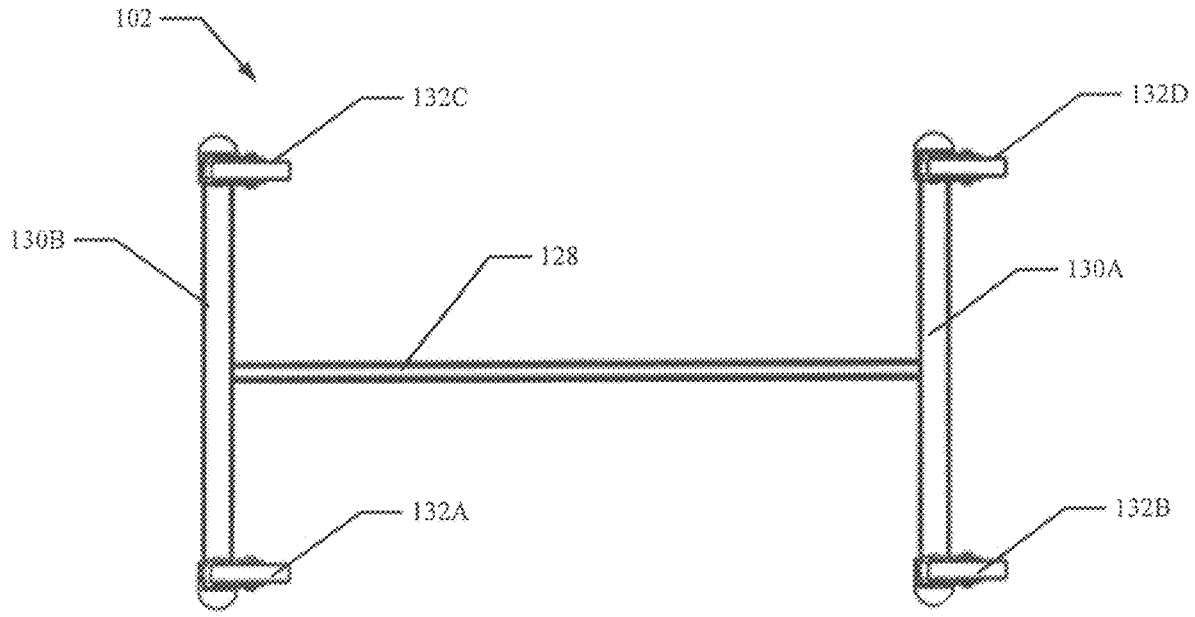
FIG. 2B is a bottom view diagram of a convertible apparel rack, according to another example embodiment.
Figure 2C:
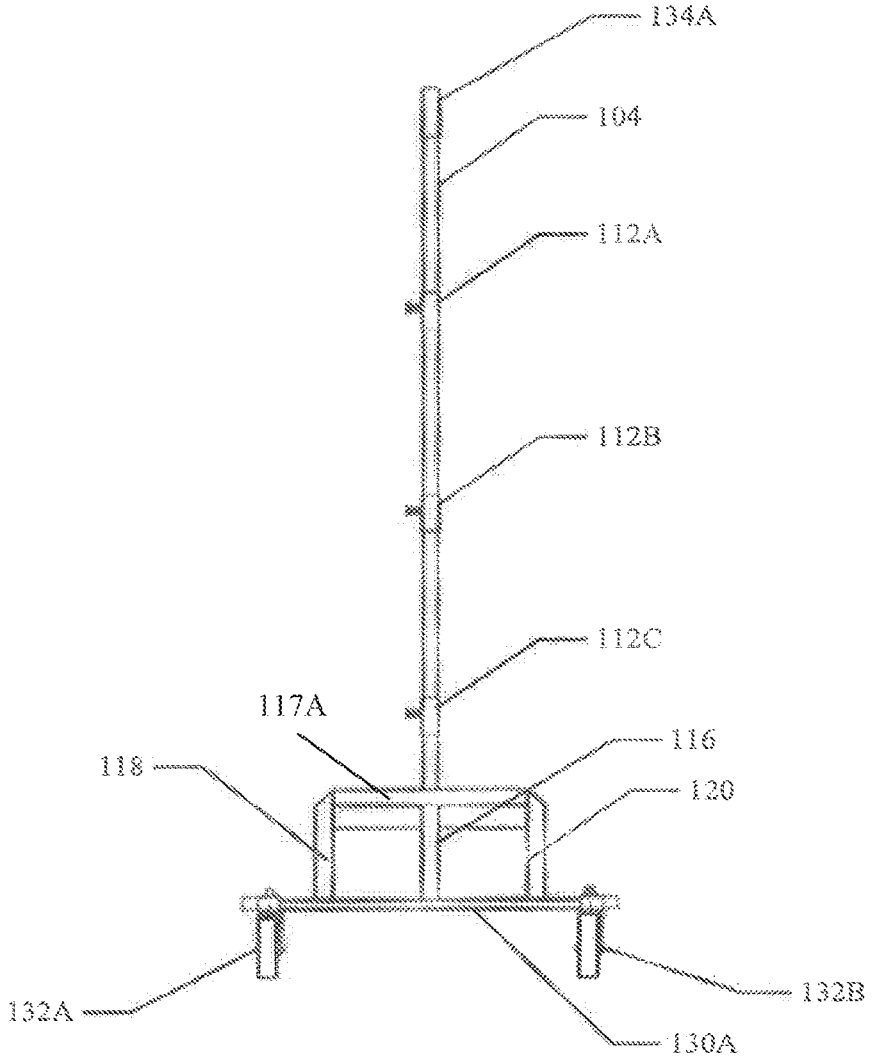
FIG. 2C is a side view diagram of a convertible apparel rack, according to another example embodiment.
Figure 2D:
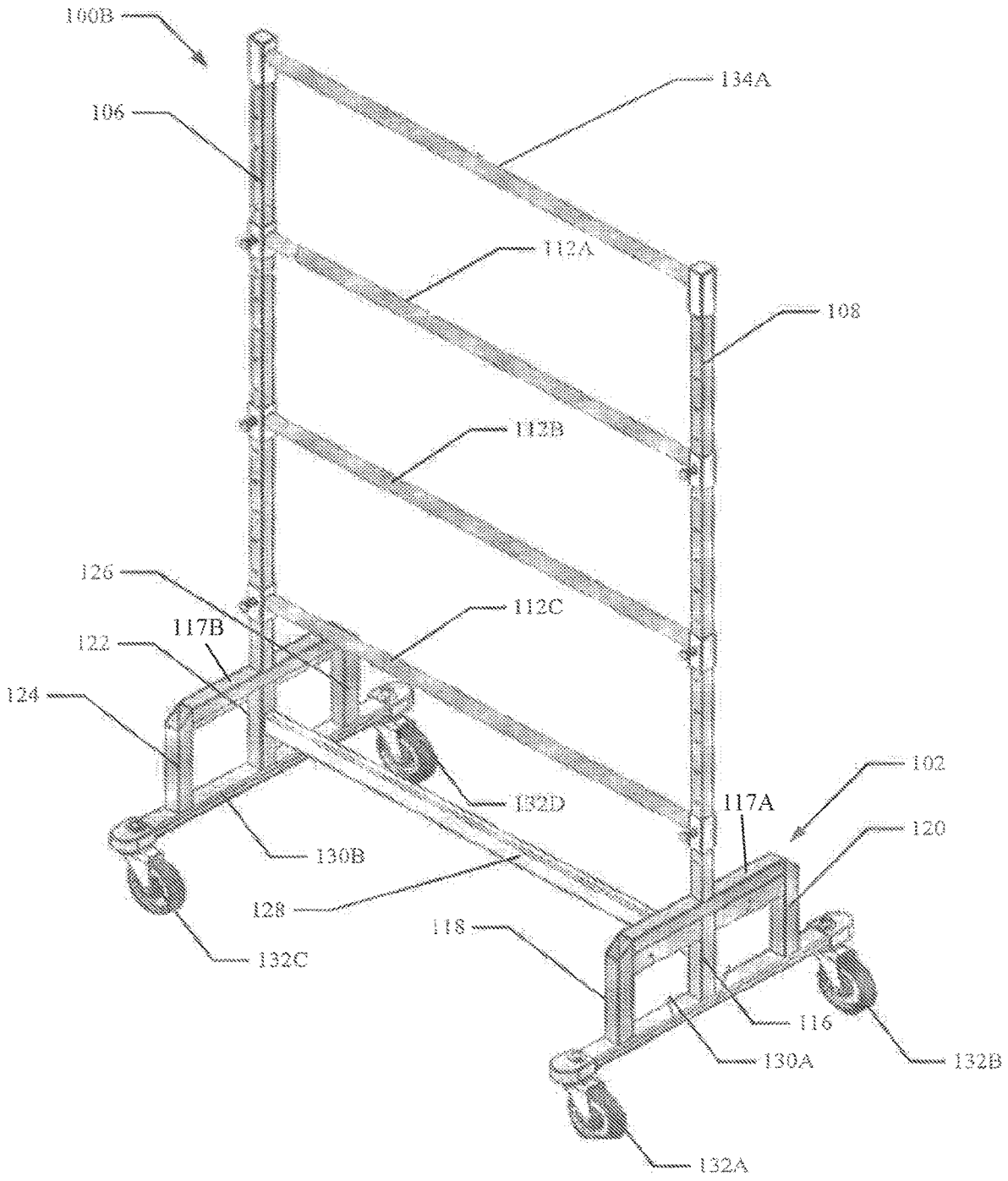
FIG. 2D is an isometric view diagram of a convertible apparel rack, according to another example embodiment.

Referring to FIG. 1A, a first hanger bar 112*a* is removably attachable to the first upright 104 and the second upright 106. A hanger bar can support clothing hangers for displaying a variety of clothing items. The first upright and the second upright have a plurality of holes at predefined locations on the upright. The hanger bar has a hole proximate each end of the hanger bar which can be aligned with a hole on the first upright and the second upright. The hanger bar can be removably attached to the uprights by using a securing element connecting the hanger bar to the upright at the desired location. Multiple hanger bars (e.g., 112*b*, 112*c*) may also be attached to uprights 104 and 106 at different heights, as determined by a user. In a similar manner, as shown in FIG. 1D, hanger bars 112*d*, 112*e* and 112*f* can be attached to uprights 108 and 110. A top hanger bar 134*a* has a slightly different configuration, wherein this hanger bar includes a cap on each end. The cap is sized to fit over the end of an upright, and thus does not require a securing element to attach the top hanger bar to the uprights. Top hanger bar 134*b* has a similar configuration as top hanger bar 134*a*, and is installed in a similar manner. While four garment hanger bars are shown in FIG. 1D, it should be appreciated that any number of hanger bars could be used.

The convertible apparel rack may further include a first stiffener bar 114*a* in removable mechanical communication with the first upright and the third upright. The stiffener bar has a hole proximate each end of the stiffener bar which can be aligned with a hole on the first upright and the third upright. The stiffener bar can be removably attached to the uprights by using a securing element connecting the stiffener bar to the upright at the desired location. A second stiffener bar 114*b* is show attached to upright 106 and upright 110. The convertible apparel rack may further include a first bottom stiffener bar 117A interconnecting the first set of upright supports 116, 118, 120, and a second bottom stiffener bar 117B interconnecting the second set of upright supports 122, 124, 126.

As shown in FIG. 1D, base 102 includes a first plurality of upright supports (116, 118, 120) along a first side of the base. Base 102 also includes a second plurality of upright supports (122, 124, 126). In this embodiment, the outer upright supports (118, 120, 124, and 126) are used. The first upright 104 is inserted into the upright support 118 and third upright 108 is inserted in upright support 120. Similarly, second upright 106 is inserted into the upright support 124 and fourth upright 110 is inserted in upright support 126.

Base 102 may further include a base cross member 128 in mechanical communication with one of the first plurality of upright supports and one of the second plurality of upright supports. Also included as part of base 102 is a first base support 130*a* in mechanical communication with the first plurality of upright supports, and a second base support 130*b* in mechanical communication with the second plurality of upright supports. First base support 130*a* includes a first caster 132*a* disposed proximate a first end of the first base support 130*a* and a second caster 132*b* disposed proximate a second end of the first base support 130*a*. Second base support 130*b* includes a third caster 132*c* disposed proximate a first end of the second base support 130*b* and a fourth caster 132*d* disposed proximate a second end of the second base support 130*b*.

The convertible apparel rack may further include a label to identify the rack. The label may be a sign 140 magnetically attachable to the rack, a bar code label 142 applied to the rack that is machine readable, or a Radio Frequency Identification (RFID) tag 144 attached to the rack. The label is useful for keeping track of the location of the convertible garment rack and/or indicating the use of the rack.

Referring to FIGS. 2A to 2D, another embodiment 100*b* of a convertible apparel rack is shown. This embodiment is used to display a single row of clothing and may be referred to as a single garment rack. The convertible apparel rack 100*b* includes a base 102. A first upright 104 is in removable mechanical communication with the base 102 at a center upright support 116. A second upright 106 is in removable mechanical communication with the base 102 at a center upright support 122.

A first hanger bar 112*a* is removably attachable to the first upright 104 and the second upright 106. The first upright and the second upright have a plurality of holes at predefined location on the upright. The hanger bar has a hole proximate each end of the hanger bar which can be aligned with a hole on the first upright and the second upright. The hanger bar can be removably attached to the uprights by using a securing element connecting the hanger bar to the upright at the desired location. Multiple hanger bars (e.g., 112*b*, 112*c*) may also be attached to uprights 104 and 106. A top hanger bar 134*a* has a slightly different configuration, wherein this hanger bar includes a cap on each end. The cap is sized to fit over the end of an upright, and thus does not require a securing element to attach the top hanger bar to the uprights.

Base 102 includes a first plurality of upright supports (116, 118, 120) along a first side of the base. Base 102 also includes a second plurality of upright supports (122, 124, 126). In this embodiment, the center upright supports (116 and 122) are used. The first upright 104 is inserted into the upright support 116 and second upright 106 is inserted into the upright support 122.

Base 102 also includes a base cross member 128 in mechanical communication with one of the first set of upright supports and one of the second set of upright supports. Also included as part of base 102 is a first base support 130*a* in mechanical communication with the first set of upright supports and a second base support 130*b* in mechanical communication with the second set of upright supports. First base support 130*a* includes a first caster 132*a* disposed proximate a first end of the first base support 130*a* and a second caster 132*b* disposed proximate a second end of the first base support 130*a*. Second base support 130*b* includes a third caster 132*c* disposed proximate a first end of the second base support 130*b* and a fourth caster 132*d* disposed proximate a second end of the second base support 130*b*.

The convertible apparel rack can be converted from the dual garment rack 100*a* of FIGS. 1A-1D to the single garment rack 100*b* of FIGS. 2A-2D by removal and insertion of appropriate uprights and removal and installation of different hanger bars. For example, hanger bars 112*a*-112*f* and top hanger bars 134*a*-134*b* can be removed. Uprights 104, 106, 108 and 110 are removed from base 102. Upright 104 is inserted into upright support 116 of base 102 and upright 106 is inserted into upright support 122. Hanger bars 112*a*-112*c* are installed at the appropriate heights to uprights 104 and 106, and top hanger bar 134*a* is installed.

Figure 3A:
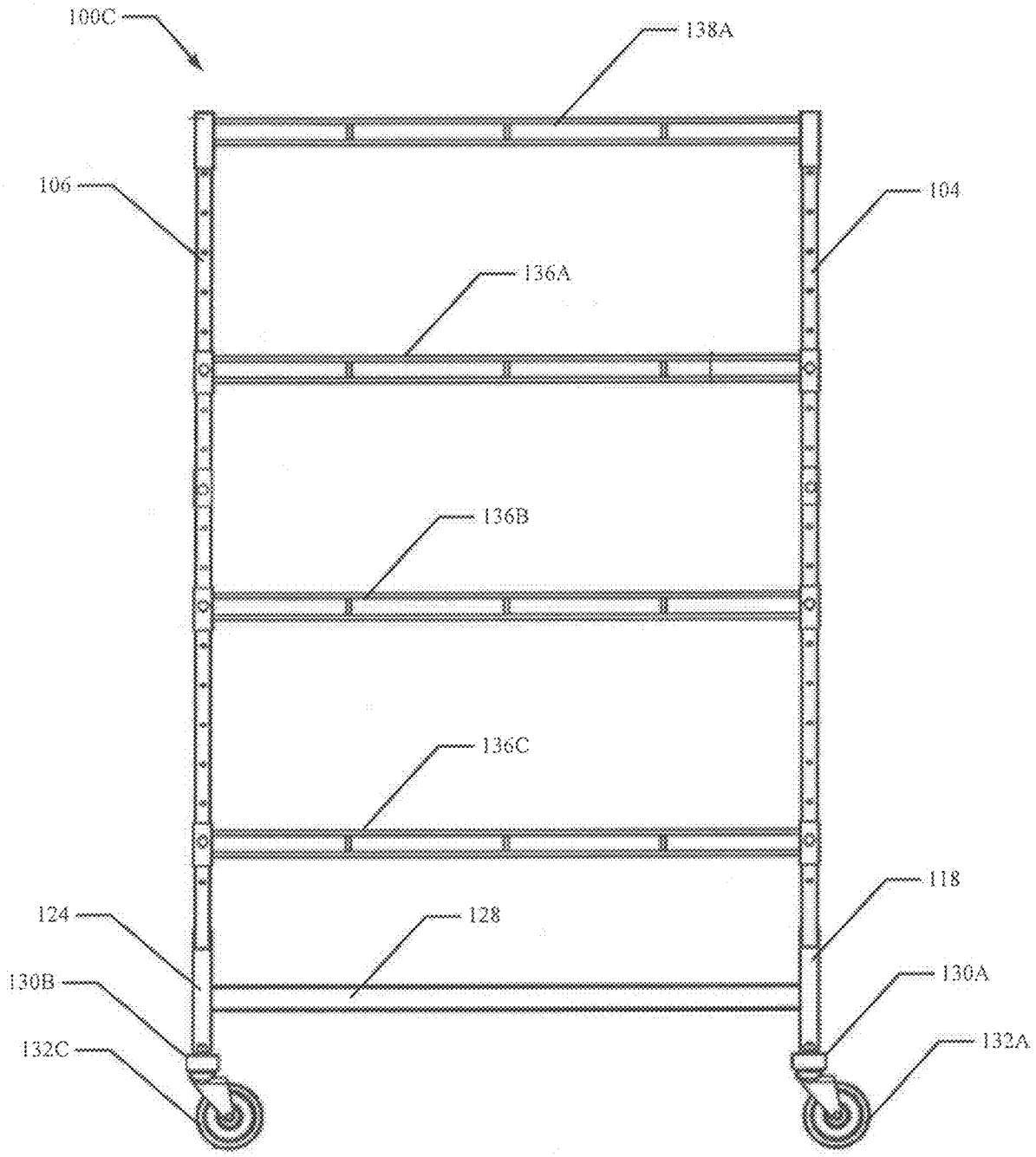
FIG. 3A is a front view diagram of a convertible apparel rack, according to another example embodiment.
Figure 3B:
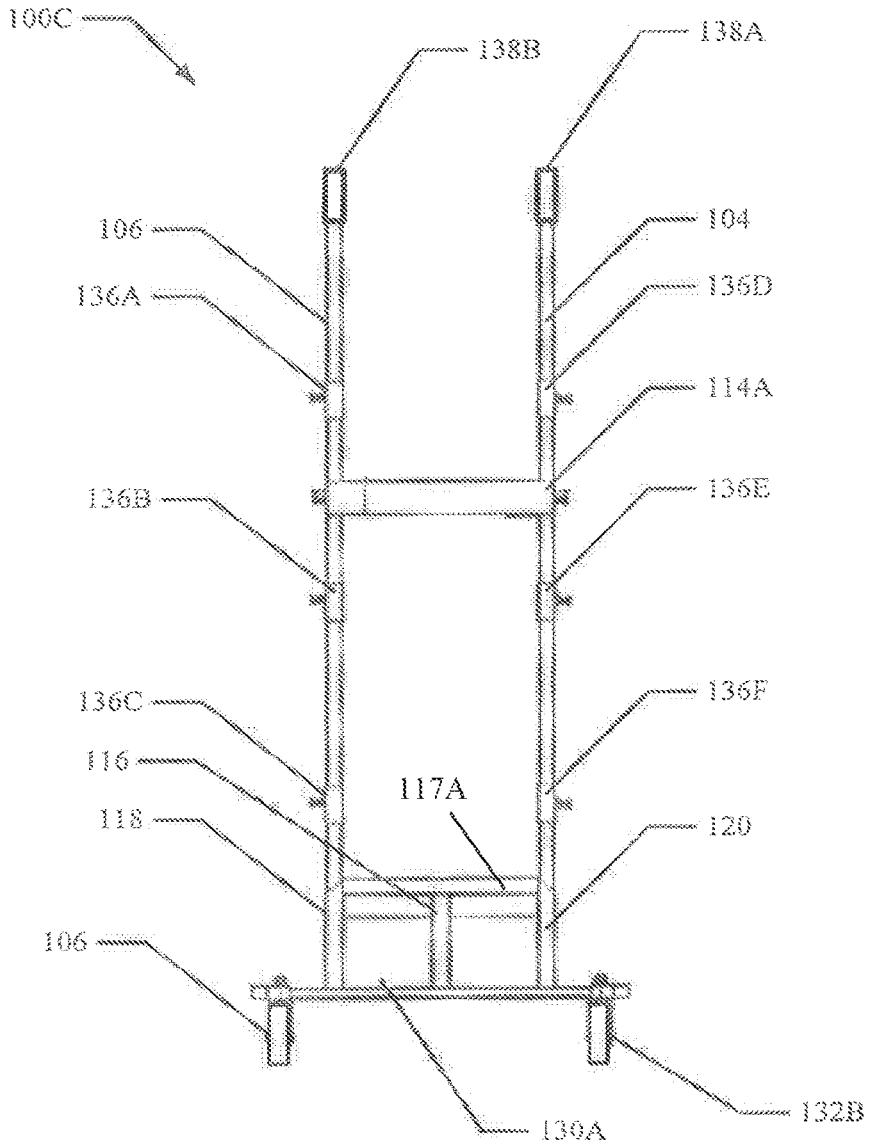
FIG. 3B is a side view diagram of a convertible apparel rack, according to another example embodiment.
Figure 3C:
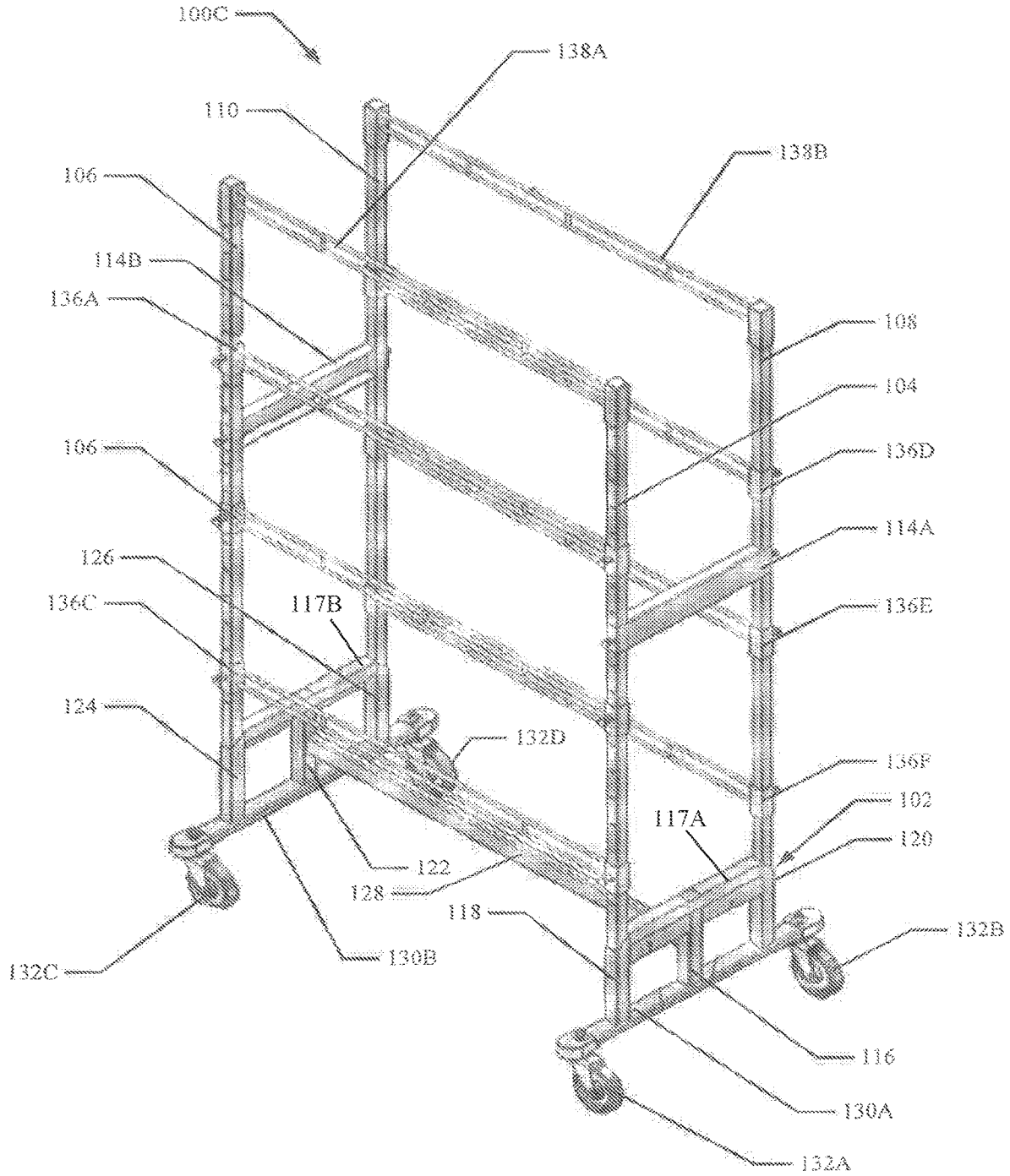
FIG. 3C is an isometric view diagram of a convertible apparel rack, according to another example embodiment.

Referring to FIGS. 3A to 3C, another embodiment 100*c* of a convertible apparel rack is shown. This embodiment is used to display two rows of shoes and may be referred to as a dual shoe rack. A first shoe hanger bar 136*a* is removably attachable to the first upright 104 and the second upright 106. The first upright and the second upright have a plurality of holes at predefined location on the upright. The shoe hanger bar has a hole proximate each end of the shoe hanger bar which can be aligned with a hole on the first upright and the second upright. The shoe hanger bar can be removably attached to the uprights by using a securing element connecting the shoe hanger bar to the upright at the desired location. Multiple shoe hanger bars (e.g., 136*b*, 136*c*) may also be attached to uprights 104 and 106. In a similar manner, shoe hanger bars 136*d*, 136*e* and 136*f* can be attached to uprights 108 and 110. A top shoe hanger bar 138*a* has a slightly different configuration, wherein this shoe hanger bar includes a cap on each end. The cap is sized to fit over the end of an upright, and thus does not require a securing element to attach the top shoe hanger bar to the uprights. Top shoe hanger bar 138*b* has a similar configuration as top shoe hanger bar 138*a* and is installable in a similar manner as top shoe hanger bar 138*a*. A shoe hanger bar has openings wherein a pair of shoes which are attached to a clip can be clipped to the shoe hanger bar through the opening to display the shoes.

The convertible apparel rack 100*c* includes a base 102. A first upright 104 is in removable mechanical communication with the base 102 at upright support 118. A second upright 106 is in removable mechanical communication with the base 102 at upright support 116. A third upright 108 is in removable mechanical communication with the base at base support 120. A fourth first upright 110 is in removable mechanical communication with the base at upright support 126.

A first shoe hanger bar 136*a* is removably attachable to the first upright 104 and the second upright 106. The first upright and the second upright have a plurality of holes at predefined location on the upright. The shoe hanger bar has a hole proximate each end of the shoe hanger bar which can be aligned with a hole on the first upright and the second upright. The shoe hanger bar can be removably attached to the uprights by using a securing element connecting the shoe hanger bar to the upright at the desired location. Multiple shoe hanger bars (e.g., 136*b*, 136*c*) may also be attached to uprights 104 and 106. In a similar manner, shoe hanger bars 136*d*, 136*e* and 136*f* can be attached to uprights 108 and 110. A top shoe hanger bar 138*a* has a slightly different configuration, wherein this shoe hanger bar includes a cap on each end. The cap is sized to fit over the end of an upright, and thus does not require a securing element to attach the top shoe hanger bar to the uprights. Top shoe hanger bar 138*a* has a similar configuration as top shoe hanger bar 138*b*.

The convertible apparel rack may further include a first stiffener bar 114*a* in removable mechanical communication with the first upright and the third upright. The stiffener bar has a hole proximate each end of the stiffener bar which can be aligned with a hole on the first upright and the third upright. The stiffener bar can be removably attached to the uprights by using a securing element connecting the stiffener bar to the upright at the desired location. A second stiffener bar 114*b* is show attached to upright 106 and upright 110. The convertible apparel rack may further include a first bottom stiffener bar 117A interconnecting the first set of upright supports 116, 118, 120, and a second bottom stiffener bar 117B interconnecting the second set of upright supports 122, 124, 126.

Base 102 includes a first plurality of upright supports (116, 118, 120) along a first side of the base. Base 102 also includes a second plurality of upright supports (122, 124, 126). In this embodiment, the outer upright supports (118, 120, 124, and 126) are used. The first upright 104 is inserted into the upright support 118 and third upright 108 is inserted in upright support 120. Similarly, second upright 106 is inserted into the upright support 124 and fourth upright 110 is inserted in upright support 126.

Base 102 also includes a base cross member 128 in mechanical communication with one of the first plurality of upright supports and one of the second plurality of upright supports. Also included as part of base 102 is a first base support 130*a* in mechanical communication with the first plurality of upright supports and a second base support 130*b* in mechanical communication with the second plurality of upright supports. First base support 130*a* includes a first caster 132*a* disposed proximate a first end of the first base support 130*a* and a second caster 132*b* disposed proximate a second end of the first base support 130*a*. Second base support 130*b* includes a third caster 132*c* disposed proximate a first end of the second base support 130*b* and a fourth caster 132*d* disposed proximate a second end of the second base support 130*b*.

Figure 4:
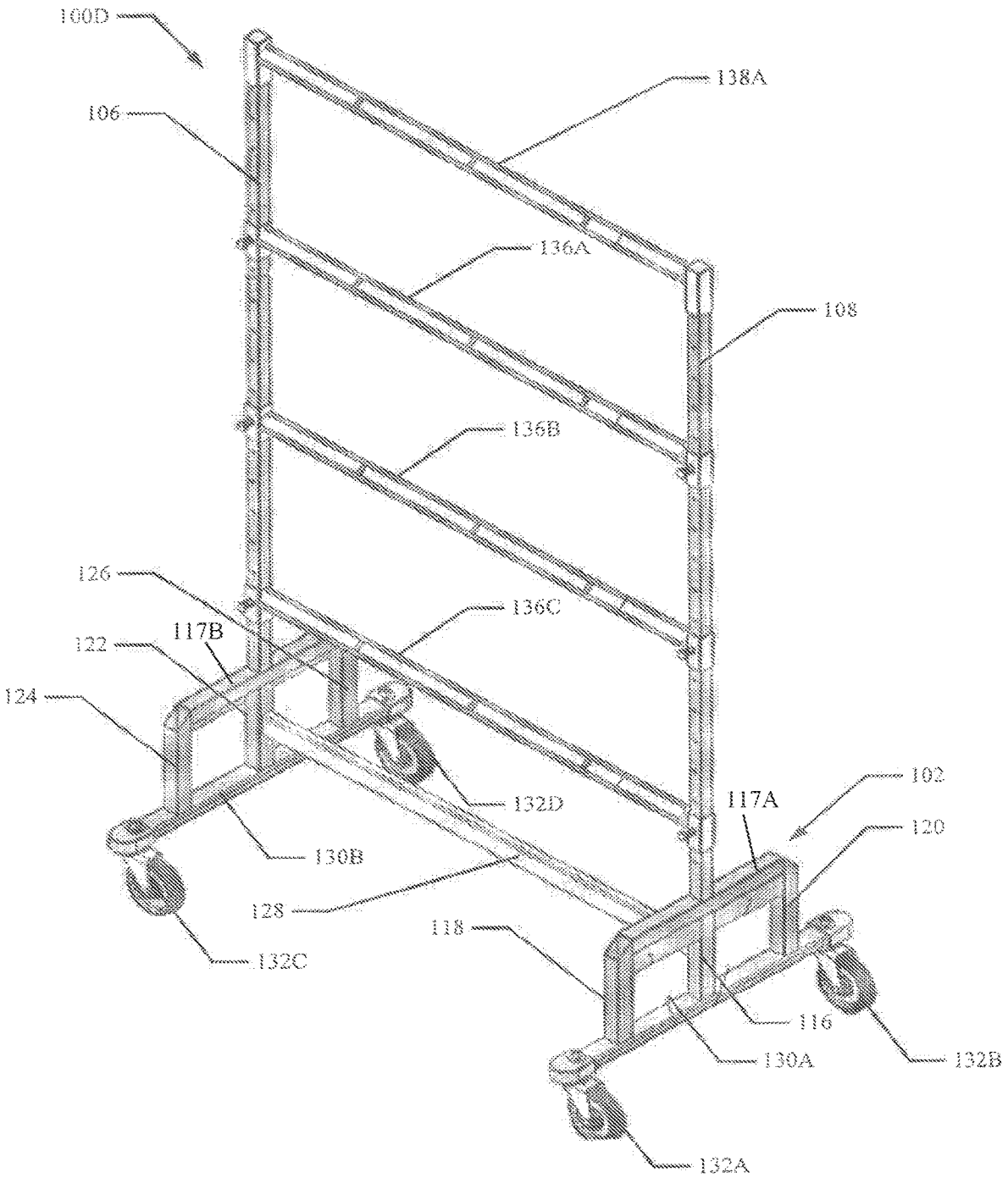
FIG. 4 is an isometric view diagram of a convertible apparel rack, according to another example embodiment.

Similar to the single garment rack 100*a* of a convertible apparel rack, a single shoe rack embodiment may also be configured, shown in an isometric view in FIG. 4. This embodiment is used to display a single row of shoes, and may be referred to as a single shoe rack 100D. The single shoe rack is substantially similar to the single garment rack 102*b*, except that the garment hanger bars have been replaced with shoe hanger bars.

This embodiment is used to display a single row of shoes. As with the single garment rack, the convertible apparel rack 100D includes a base 102. A first upright 104 is in removable mechanical communication with the base 102 at a center upright support 116. A second upright 106 is in removable mechanical communication with the base 102 at a center upright support 122.

A first shoe hanger bar 136*a* is removably attachable to the first upright 104 and the second upright 106. The first upright and the second upright have a plurality of holes at predefined location on the upright. The shoe hanger bar 136*a* has a hole proximate each end of the shoe hanger bar which can be aligned with a hole on the first upright and the second upright. The shoe hanger bar 136*a* can be removably attached to the uprights by using a securing element connecting the hanger bar to the upright at the desired location. Multiple hanger bars (e.g., 136*b*, 136*c*) may also be attached to uprights 104 and 106. A top hanger bar 138*a* has a slightly different configuration, wherein this top hanger bar includes a cap on each end. The cap is sized to fit over the end of an upright, and thus does not require a securing element to attach the top hanger bar to the uprights.

Base 102 includes a first plurality of upright supports (116, 118, 120) along a first side of the base. Base 102 also includes a second plurality of upright supports (122, 124, 126). In this embodiment, the center upright supports (116 and 122) are used. The first upright 104 is inserted into the upright support 116 and second upright 106 is inserted into the upright support 122.

Base 102 also includes a base cross member 128 in mechanical communication with one of the first set of upright supports and one of the second set of upright supports. Also included as part of base 102 is a first base support 130*a* in mechanical communication with the first set of upright supports and a second base support 130*b* in mechanical communication with the second set of upright supports. First base support 130*a* includes a first caster 132*a* disposed proximate a first end of the first base support 130*a* and a second caster 132*b* disposed proximate a second end of the first base support 130*a*. Second base support 130*b* includes a third caster 132*c* disposed proximate a first end of the second base support 130*b* and a fourth caster 132*d* disposed proximate a second end of the second base support 130*b*.

Figure 5:
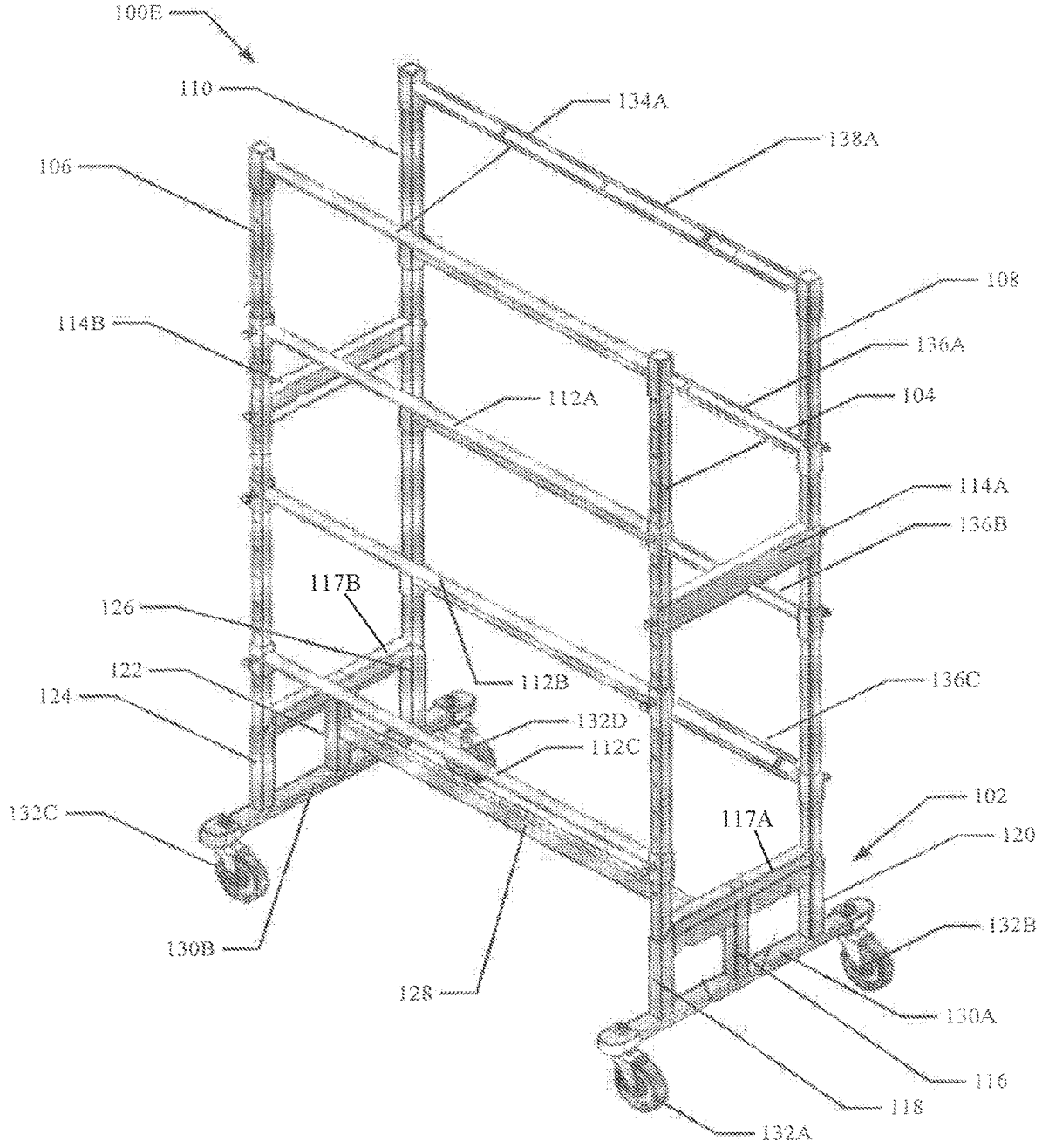
FIG. 5 is an isometric view diagram of a convertible apparel rack, according to another example embodiment.

FIG. 5 depicts another exemplary embodiment, a combination garment and shoe rack 100E. The combination rack 100E is similar to the dual garment rack 100*a* except that the garment hanger racks 112*d*-112*f* are replaced with shoe racks 136*a*-136*c*. Top garment hanger bar 134*b* is replaced with top shoe hanger rack 138*a*.

The convertible apparel rack 100E includes a base 102. A first upright 104 is in removable mechanical communication with the base 102 by being inserted into upright support 118 at a first corner. A second upright 106 is in removable mechanical communication with the base 102 by being inserted into upright support 124 at a second corner. A third upright 108 is in removable mechanical communication with the base 102 by being inserted into upright support 120 at a third corner. A fourth first upright 110 is in removable mechanical communication with the base 102 by being inserted into upright support 126 at a fourth corner.

A first hanger bar 112*a* is removably attachable to the first upright 104 and the second upright 106. The first upright and the second upright have a plurality of holes at predefined locations on the upright. The hanger bar has a hole proximate each end of the hanger bar which can be aligned with a hole on the first upright and the second upright. The hanger bar can be removably attached to the uprights by using a securing element connecting the hanger bar to the upright at the desired location. Multiple hanger bars (e.g., 112*b*, 112*c*) may also be attached to uprights 104 and 106 at different heights, as determined by a user. In a similar manner, shoe hanger bars 136*a*, 136*b* and 136*c* can be attached to uprights 108 and 110. A top hanger bar 138*a* has a slightly different configuration, wherein this hanger bar includes a cap on each end. The cap is sized to fit over the end of an upright, and thus does not require a securing element to attach the top hanger bar to the uprights. Top hanger bar 138*a* has a similar configuration as top hanger bar 134*a*, and is installed in a similar manner.

The convertible apparel rack may further include a first stiffener bar 114*a* in removable mechanical communication with the first upright and the third upright. The stiffener bar has a hole proximate each end of the stiffener bar which can be aligned with a hole on the first upright and the third upright. The stiffener bar can be removably attached to the uprights by using a securing element connecting the stiffener bar to the upright at the desired location. A second stiffener bar 114*b* is show attached to upright 106 and upright 110. The convertible apparel rack may further include a first bottom stiffener bar 117A interconnecting the first set of upright supports 116, 118, 120, and a second bottom stiffener bar 117B interconnecting the second set of upright supports 122, 124, 126.

Base 102 includes a first plurality of upright supports (116, 118, 120) along a first side of the base. Base 102 also includes a second plurality of upright supports (122, 124, 126). In this embodiment, the outer upright supports (118, 120, 124, and 126) are used. The first upright 104 is inserted into the upright support 118 and third upright 108 is inserted in upright support 120. Similarly, second upright 106 is inserted into the upright support 124 and fourth upright 110 is inserted in upright support 126.

Base 102 may further include a base cross member 128 in mechanical communication with one of the first plurality of upright supports and one of the second plurality of upright supports. Also included as part of base 102 is a first base support 130*a* in mechanical communication with the first plurality of upright supports, and a second base support 130*b* in mechanical communication with the second plurality of upright supports. First base support 130*a* includes a first caster 132*a* disposed proximate a first end of the first base support 130*a* and a second caster 132*b* disposed proximate a second end of the first base support 130*a*. Second base support 130*b* includes a third caster 132*c* disposed proximate a first end of the second base support 130*b* and a fourth caster 132*d* disposed proximate a second end of the second base support 130*b*.

Having described certain embodiments, which serve to illustrate various concepts, structures, and techniques sought to be protected herein, it will be apparent to those of ordinary skill in the art that other embodiments incorporating these concepts, structures, and techniques may be used. Elements of different embodiments described hereinabove may be combined to form other embodiments not specifically set forth above and, further, elements described in the context of a single embodiment may be provided separately or in any suitable sub-combination. Accordingly, it is submitted that the scope of protection sought herein should not be limited to the described embodiments but rather should be limited only by the spirit and scope of the following claims.

We claim:

1. A convertible apparel rack comprising:

a base comprising:

a first set of three hollow upright supports along a first side of the base, wherein the first set of three hollow upright supports each have an opening at a top end thereof respectively;

a second set of three hollow upright supports along a second side of the base, wherein the second set of three hollow upright supports each have an opening at a top end thereof respectively;

a first base support, wherein a top surface of the first base support is directly connected to bottoms of the first set of three hollow upright supports;

a second base support, wherein a top surface of the second base support is directly connected to bottoms of the second set of three hollow upright supports;

a first caster disposed proximate a first end of said first base support;

a second caster disposed proximate a second end of said first base support;

a third caster disposed proximate a first end of said second base support; and a fourth caster disposed proximate a second end of said second base support;

a first upright removably inserted within a corresponding first hollow upright support from the first set of three hollow upright supports;

a second upright removably inserted within a corresponding second hollow upright support from the second set of three hollow upright supports;

a first hanger bar removably attachable to the first upright and the second upright;

a third upright removably inserted within a corresponding third hollow upright support from the first set of three hollow upright supports;

a fourth upright removably inserted within a corresponding fourth hollow upright support from the second set of three hollow upright supports;

a first bottom stiffener bar extending above the first base support with a gap defined therebetween and interconnecting the first set of three upright supports without covering any of the openings at the top ends of the first set of three upright supports; and a second bottom stiffener bar located opposite the first bottom stiffener bar and extending above the second base support with a gap defined therebetween and interconnecting the second set of three upright supports without covering any of the openings at the top ends of the second set of three upright supports;

wherein a fifth corresponding hollow upright support from the first set of three hollow upright supports is configured to receive one of the first and third uprights when the one of the first and third uprights is removed from the corresponding first or third hollow upright supports;

wherein a sixth corresponding hollow upright support from the second set of three hollow upright supports is configured to receive one of the second and fourth uprights when the one of the second and fourth uprights is removed from the corresponding second or fourth hollow upright supports.

2. The convertible apparel rack of claim 1, further comprising a second hanger bar removably attachable to the third upright and the fourth upright.

3. The convertible apparel rack of claim 2, wherein the second hanger bar is a garment hanger bar having a continuous outside surface.

4. The convertible apparel rack of claim 3, wherein the second hanger bar is a second shoe hanger bar having a plurality of openings disposed therein.

5. The convertible apparel rack of claim 1, further comprising a first top stiffener bar in removable mechanical communication with the first upright and the third upright.

6. The convertible apparel rack of claim 5, further comprising a second top stiffener bar in removable mechanical communication with the second upright and the fourth upright.

7. The convertible apparel rack of claim 1, wherein the first hanger bar is a garment hanger bar having a continuous outside surface.

8. The convertible apparel rack of claim 1, wherein the first hanger bar is a shoe display bar having a plurality of openings disposed therein.

9. The convertible apparel rack of claim 1, wherein the base further comprises:

a base cross member directly connected to one of the first set of upright supports and one of the second set of upright supports.

10. The convertible apparel rack of claim 1, wherein each upright includes a plurality of holes for providing a height of the first hanger bar or a second hanger bar from a floor which is configurable by a user.

11. The convertible apparel rack of claim 1, further comprising a bar code label for identifying the convertible apparel rack.

12. The convertible apparel rack of claim 1, further comprising an RFID tag for identifying the convertible apparel rack.

13. The convertible apparel rack of claim 1, further comprising a magnetic sign for identifying the convertible apparel rack.

14. The convertible apparel rack of claim 1, wherein a top hanger bar includes a cap for fitting over an upper end of the first upright or the second upright.

15. The convertible apparel rack of claim 1, wherein an overall width of the convertible apparel rack is less than or equal to about 48 inches.

16. The convertible apparel rack of claim 1, wherein an overall height of the convertible apparel rack is less than or equal to about 72 inches.

17. The convertible apparel rack of claim 1, wherein an overall depth of the convertible apparel rack is less than or equal to about 30.6 inches.

* * * * *